US005108520A

United States Patent [19]

Liu et al.

[11] Patent Number: 5,108,520

[45] Date of Patent: Apr. 28, 1992

[54] HEAT TREATMENT OF PRECIPITATION HARDENING ALLOYS

[75] Inventors: John Liu, Lower Burrell, Pa.; Michael M. Kersker, Beverly, Mass.

[73] Assignee: Aluminum Company of America, Pittsburgh, Pa.

[21] Appl. No.: 365,442

[22] Filed: Jun. 13, 1989

Related U.S. Application Data

[63] Continuation-in-part of Ser. No. 19,995, Feb. 27, 1980, abandoned.

[51] Int. Cl.[5] ..... C22F 1/04

[52] U.S. Cl. ..... 148/12.7 R; 148/159; 148/405; 148/417

[58] Field of Search ..... 148/159, 12.7 R, 417, 148/405

[56] References Cited

U.S. PATENT DOCUMENTS 3,881,966 5/1975 Staley et al. ..... 148/12.7 R
4,477,292 10/1984 Brown ..... 148/159
4,832,758 5/1989 Brown ..... 148/12.7 A

FOREIGN PATENT DOCUMENTS 1480351 7/1977 United Kingdom .

OTHER PUBLICATIONS

"Investigation to Improve Stress-Corrosion Resistance of Aluminum Aircraft Alloys Through Alloy Additions and Specialized Heat Treatment", J. T. Staley, Naval Air Systems Command Contract N00019-68-C-0146 (Final Report), Feb. 28, 1969.

*Primary Examiner*—R. Dean
*Assistant Examiner*—Robert R. Koehler
*Attorney, Agent, or Firm*—Daniel A. Sullivan, Jr.

[57] ABSTRACT

An aging process for solution-heat-treated, precipitation hardening metal alloy includes first underaging the alloy, such that a yield strength below peak yield strength is obtained, followed by higher aging for improving the corrosion resistance of the alloy, followed by lower temperature aging to strength increased over that achieved initially.

54 Claims, 11 Drawing Sheets

TEMP., °F
375
250
70
3 MIN. HEATING TIME
AIR COOLED
CWQ
24 hr.
24 hr.
TIME

TEMP., °F
375
250
70
11 MIN. HEATING TIME
AIR COOLED
CWQ
24 hr.
24 hr.
TIME

TEMP., °F
375
250
70
FURNACE COOLED
45 MIN. HEATING TIME
24 hr.
24 hr.
TIME

TEMP., °F
365
250
70
38 MIN. HEATING TIME
AIR COOLED
24hr.
24hr.
TIME

HEAT TREATMENT OF PRECIPITATION HARDENING ALLOYScl CROSS-REFERENCE TO RELATED APPLICATION

This is a continuation-in-part of U.S. patent application Ser. No. 07/019,995 filed Feb. 27, 1987, now abandoned.

DESCRIPTION

1. Technical Field

This invention relates to the heat treatment of precipitation hardening alloys, particularly those of aluminum.

2. Background Art

Although high-solute alloys of the 7000 series (Al-Zn-Mg-Cu) aluminum alloys provide high strength and stiffness, they are susceptible to exfoliation and stress-corrosion cracking (SCC) when aged to the near peak strength T6-type tempers. Optimization of chemical composition and thermal treatments to improve the corrosion resistance became a major emphasis in alloy development. An important outcome was the discovery of T76 and T73 type tempers (See Sprowls, D. O. and Brown, R. H., *Metals Progr.*, Vol. 81 (1962), p. 77), which provide increased resistance to exfoliation and SCC through overaging. However, these treatments also result in a 11–17% loss in strength for 7075 and 7×50 alloys.

In 1974, Cina of Israeli Aircraft Company disclosed a three-step aging treatment, known as Retrogression and Reaging (RRA) which employed 3 steps, one at about 250° F., followed by a very brief (typically 30 second) step at a higher temperature such as around 420° F., followed by a third step at about 250° F. See: Cina, B. and Ranish, B., "New Technique for Reducing Susceptibility to Stress Corrosion of High Strength Aluminum Alloys" in *Aluminum Industrial Products*, Pittsburgh Chapter, ASM, 1974 October; Cina, B. in *Second Israel-Norwegian Technical and Scientific Symposium, Electrochemistry and Corrosion* (Norway, 1978 June); and U.S. Pat. No. 3,856,584; Dec. 24, 1974.

M. H. Brown (British Patent 1,480,351 of Jul. 20, 1977; U.S. Pat. Nos. 4,477,292 of Oct. 16, 1984 and 4,832,758 of May 23, 1989) of Alcoa Laboratories developed three-phase low-high-low, temperature agings that held an advantage over Cina's in using longer times and generally lower temperatures for a second (higher temperature) aging which was more applicable to commercial aging furnaces.

DISCLOSURE OF INVENTION

An object of the invention is to provide improved three-phase aging treatments for precipitation hardening alloys in general and particularly for alloys of the 7×××, also termed the 7000, series of alloys of aluminum, especially the aluminum alloys 7075 and 7050.

Another object is to provide a precipitation hardened alloy combining essentially T6 yield strength with essentially T7 corrosion resistance. In general, T6 refers to the condition of a precipitation hardening alloy in which it has been aged directly substantially to peak strength. T7 refers to a condition where corrosion resistance has been improved. In the past, strength had been sacrificed, in achieving a T7 condition. Other numbers may follow the "6" or "7" to indicate variations.

According to the invention, a specific aging sequence, which we refer to as DSA (Desaturation Aging), was found to develop unique material characteristics.

In a nutshell, our aging sequence comprises a three-phase aging of solution-heat-treated precipitation hardening alloy. In the first phase, we age to a point still significantly below peak strength. We believe this forms a uniform, fine distribution of islands of increased concentration of alloying elements. This is followed by a higher temperature aging phase wherein we increase the resistance to corrosion. We believe this second phase increases stability of the islands formed in the first phase, and, during it, elements are moved to the islands to decrease the electrochemical difference between grain boundaries and grain interiors (matrix). The third aging is performed at temperatures lower than the second phase to develop added strength and resistance to corrosion. We believe this strength is achieved by exploiting residual supersaturation.

The benefits of the invention may be thought of in the following way. The invention provides aging treatments for solution heat treated, precipitation hardenable alloys that permit attainment of various levels of corrosion resistance matching those of prior art tempers. For a given level of corrosion resistance, material treated according to the invention will tend to have significantly higher strength than those processed by conventional aging practices.

MODES OF CARRYING OUT THE INVENTION

Figure 1:
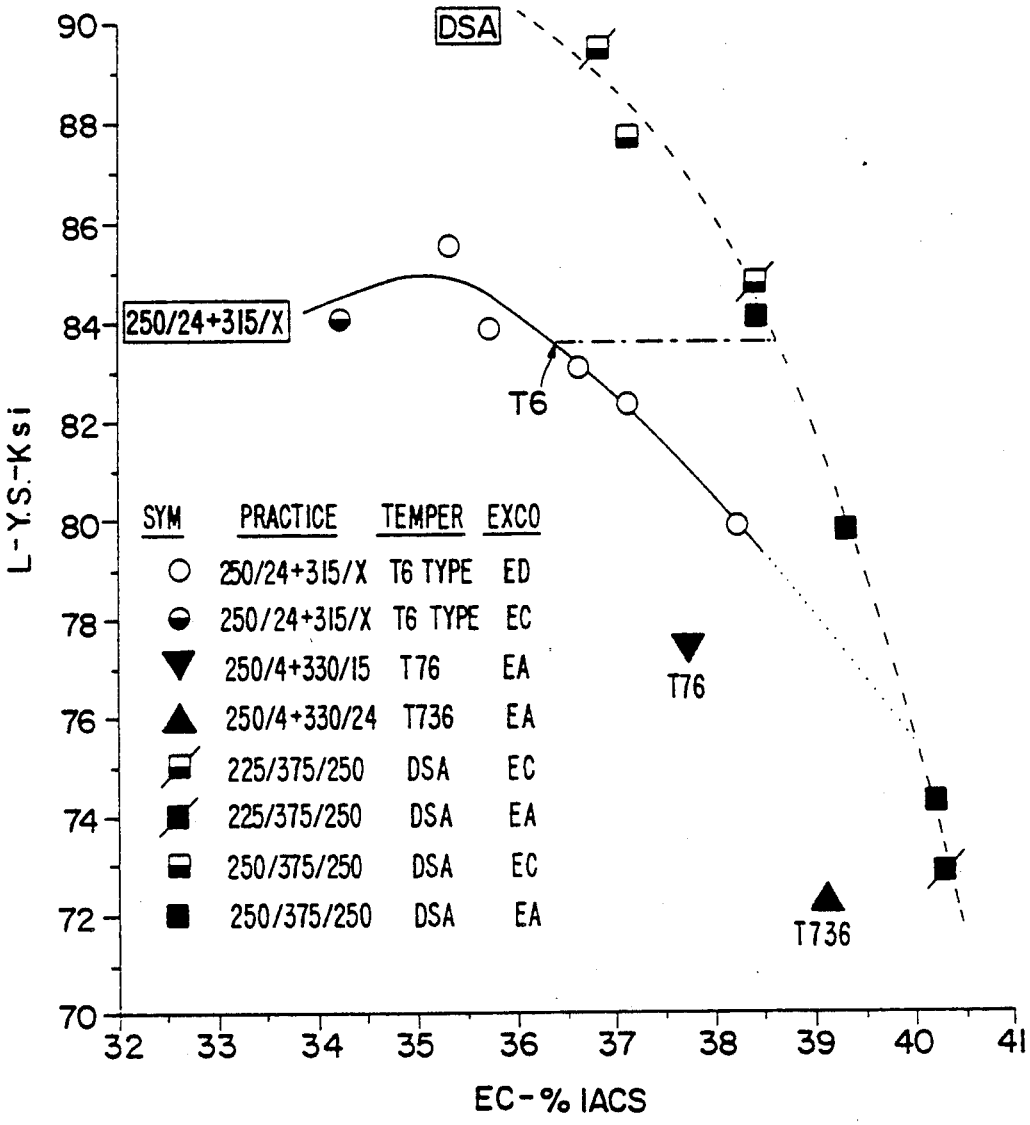
FIG. 1 presents L-YS vs. EC and EXCO ratings for aging according to the invention ("DSA"), as compared to conventional tempers, for 0.92 in. thick solution heat treated 7150 plate.

Examples of precipitation hardening metal alloys which may benefit from the principles of the invention are as follows:

Aluminum and magnesium alloys

Inconel 718

Fe-Al-Mn alloys

Cu-Be alloys

Certain steels, such as 0.2% C, 3.83% Mo, and 0.22% Ta, remainder essentially Fe, where secondary hardening is a precipitation hardening phenomenon Certain chromium steels, such as that containing 0.1% C, 12% Cr, 2% Ni, 0.02% N, remainder essentially Fe In the case of magnesium alloys, examples of precipitation hardenable alloys are those based on the combination of magnesium with zinc.

The present invention is particularly advantageous in the case of the 7×××series of aluminum alloys.

The 7××× series of aluminum alloys has, in general, a composition as follows: 4 to 12%, typically 4 to 8%, zinc, 1.5 to 3.5% magnesium, 1 to 3.5% copper, and at least one element from the group chromium at 0.05 to 0.35%, manganese at 0.1 to 0.7%, and zirconium at 0.05 to 0.3%, the alloy further permitting the presence of titanium at 0 to 0.2%, iron at 0 to 0.5%, silicon at 0 to 0.4%, boron at 0 to 0.002%, beryllium at 0 to 0.005%, others each at 0 to 0.05%, others total at 0 to 0.15%.

The invention is especially applicable to the 7×50 subseries of the 7××× series, examples being the 7050 and 7150 alloys. The composition of 7050 is about as follows: 5.7 to 6.7 zinc, 1.9 to 2.6% magnesium, 2.0 to 2.6% copper, zirconium at 0.08 to 0.15%, the alloy further permitting the presence of titanium at 0 to 0.06%, iron at 0 to 0.15%, silicon at 0 to 0.12%, others each at 0 to 0.05%, others total at 0 to 0.15% balance essentially aluminum. Alloy 7150 is a variant of 7050 with zinc, magnesium and copper in the ranges 5.9 to 6.9% zinc, 2 to 2.7% magnesium and 1.9 to 2.5% copper. Particular examples of 7×50 compositions appear in Tables I and II herein. A general composition for 7050 and 7150 (7×50) contains about 5.7 to 6.9% Zn, 1.9 to 2.7% Mg, 1.9 to 2.6% Cu, 0.08 to 0.18% Zr, balance essentially Al and impurities. These alloys are described in U.S. Pat. No. 3,881,966, which is incorporated here by reference.

Composition ranges of aluminum alloys in general, are published in:

1. Registration Record of the Aluminum Association Designations and Chemical Composition Limits for Wrought Aluminum and Wrought Aluminum Alloys, by the Aluminum Association, Inc., Washington, D.C., Rev. Jan./89, and 2. Aluminum standards and data 1988, from the same association.

Typical temperature and times for practicing the invention for 7××× aluminum alloys are a first step of 175° to 325° F. generally in terms of hours, but not including combinations of time and temperature achieving peak strength, followed by 360° to 395° F. in terms of minutes to hours, and then 175° to 325° F. again in terms of hours.

Products in accordance with this invention may be formed by the various techniques for producing metal products. Examples of such techniques are rolling, forging, extruding or any other metal working operations. Accordingly, the alloy products produced may include sheet, plate, extrusions, forgings or rods, bars or any other shapes.

The improved products of the invention are produced by providing an ingot or other suitable working stock from the alloy compositions and working said stock into the desired product, shape or configuration. Prior to working, the working stock can be homogenized by heating to a suitable high temperature, typically between about 860° and 920° F. The alloy may also be cast into final shape, although wrought or worked products are preferred. After desired working or shaping, the alloy is solution heat treated by heating to one or more elevated temperatures from about 840° or 850° F. to about 880° or 900° F., or at still higher or lower temperatures depending on alloy composition. The solution heat treatment is carried out to take into solid solution substantial portions of the alloying elements, preferably substantially all of the zinc, magnesium and copper in the case of the 7×50 aluminum alloys. It is to be recognized that physical processes are often not perfect such that every last vestige of these alloying ingredients may not be dissolved. Nonetheless, it is preferred where toughness and fatigue properties are concerned that not more than about one or two volume percent, preferably 0.5 vol. % or less, of undissolved intermetallic phases over one micron in size containing Zn, Cu and/or Mg remain in the alloy product after solutionizing.

After the aforesaid heating for solutionizing, the alloy is rapidly cooled or quenched by immersion or other suitable treatment in a quenching medium. This usually includes immersing in water, although water sprays or even air chilling may be useful in this respect. After quenching and prior to aging for precipitation hardening, the alloy may be cold worked such as by stretching to relieve internal stresses. The solution heat treated and quenched alloy, with or without cold working, is then considered to be in a precipitation-hardenable condition.

The precipitation-hardenable alloy is then aged in three steps, phases or treatments, although there may not be clear lines of demarcation between stepa or phases. That is, it is known that ramping up to a particular aging temperature and ramping down therefrom are in themselves precipitation treatments which can, and often need to be, taken into account by integrating them, and their precipitation-hardening effects, in the treatment. This effect is described in U.S. Pat. No. 3,645,804, which is incorporated herein by reference. Thus while the three phases of aging according to this invention can be effected in a single furnace operation, properly programmed, they are described herein for purposes of convenience as three phases or treatments. In accordance with the invention, the first phase or treatment precipitation hardens the alloy, but not to peak strength. Then the second phase treats the alloy at an elevated temperature to increase resistance to exfoliation corrosion and stress corrosion cracking (SCC). Then the third phase further precipitation hardens the alloy to a high strength level.

In the first phase, the alloy is precipitation hardened to strengthen it to a point substantially less than peak strength (an underaged strength). This is believed to form a uniform, fine distribution of islands of increased concentration of alloying elements. This first aging can be effected in the case of 7000-series aluminum alloy by treating at one or more temperatures between something above room temperature and about 325° F. or 330° F., preferably between about 175° F. and 325° F. This treatment typically can extend a significant period of time, typically between about 2 to 30 or more hours and can occur through a temperature ramp-up to an elevated temperature for the second treatment phase. This precipitation hardening should strengthen the alloy product substantially over the strength achieved immediately after the quenching of the solutionizing treatment (herein referred to as the as-quenched strength or solution treated strength) by at least 30% of the difference between as-quenched strength and peak yield strength, preferably to about 40% or 50% or more, for instance 60% or 70% or more of the difference between the as-quenched strength, or solution treated strength, and peak strength (the solution-peak strength differential) for the alloy product. Putting it another way, the precipitation-hardening of the alloy entering the second phase or treatment should have carried (increased) the product's strength by at least 30% (preferably more) of the way from as-quenched or solution treated strength (low strength) toward the peak strength.

The first phase can extend until the strength reaches up to about 95% of peak strength, although preferably in the case of 7000-series aluminum alloy, the strength reaches a point substantially below peak yield strength, such point being at least 3, 4, 5, and even 6 ksi or more below peak yield strength.

The alloy in the condition reached by the first phase of the aging treatment is then subjected to the second phase or treatment, in the case of 7000-series aluminum alloy, at one or more higher temperatures of about 325° or 330° or more, for instance above about 340° F. or 350° F., preferably at one or more temperatures within the range of about 360° F. to about 500° F., preferably for more than a few minutes but preferably not more than 3 hours, higher temperatures generally favoring shorter times. In general, temperatures of 360° F. or higher are preferred. The temperatures employed in the second phase normally exceed those in the first and third phases. One preferred second phase treatment for 7×50 aluminum alloys is within 360° F. to 400° F. for about 5 minutes to 2 or 2½ or 3 hours, the time depending somewhat on temperature with higher temperature favoring shorter times. The second treatment phase increases resistance to stress corrosion cracking (SCC), exfoliation and other corrosion effects. Excessive time-temperature exposure in this phase can impede the desired strength gain from the subsequent third aging phase. The second phase serves to increase the stability of the islands of increased alloying element concentration achieved in the first phase and moves additional alloying elements to the islands to decrease the electrochemical difference between grain boundaries and grain interiors.

In some embodiments of the invention, the second treatment phase proceeds by subjecting the alloy to treatment at several different temperature levels producing a cumulative time and temperature effect corresponding to an isothermal treatment within the aforesaid temperature ranges. For instance, the effects of this treatment for a particular alloy can commence at a temperature of about 345° or 350° F. and continue as the temperatures are further increased such that "ramping up" and/or "ramping down" of temperatures between about 345°, 350° or 355° F. and higher temperatures within the aforesaid range. The effect of the different times at the different temperatures can be taken into account and integrated into determining the equivalent aging effect, using the teachings of the above cited U.S. Pat. No. 3,645,804. Such treatment may proceed, for instance, for 3 or more minutes at one or more temperatures between about 360° and 490° F.; for 4 or more minutes at one or more temperatures between about 360° and 480° F.; or for 5 or more minutes at one or more temperatures between about 360° and 475° F. When referring to heating to one or more temperatures for a time of "x" minutes, such embraces heating to any number of temperatures in the designated range but for a cumulative time of "x" above the lowest temperature in the range. For instance, heating for 5 or more minutes at one or more temperatures from about 360° to 475° F. does not require holding for 5 minutes at each of several temperatures in said range, but rather, that the cumulative time at all temperatures between 360° and 475° F. is 5 minutes or more.

The second phase or treatment can be carried out by immersion in hot liquid such as molten salt, hot oil or molten metal. A furnace (hot air and/or other gases) may also be used. One advantageous practice utilizes a fluidized bed for the second treatment. Suitable media for the fluidized bed include alumina particles of about 50 or 60 mesh. The fluid bed heating media can provide fairly rapid heating (faster than a hot air furnace but slower than molten salt) and uniform heating of large or complex parts while presenting easier clean-up and environmental aspects than some other approaches. Induction heaters may also be used in the practice of the invention.

As indicated elsewhere herein, heating operations can be ramped-up fairly slowly such that much or even all of the treatments, especially the precipitation-hardening treatments of the first and/or third phases, can be accomplished by or during ramping-up to and/or -down from the elevated second phase temperature or temperatures such that there may not be discrete disruptions or interruptions between phases. However, the second phase can be considered to start when the corrosion properties start to improve. This typically involves some time at temperatures of about 340° or 350° 360° for so, in the case of 7000-series aluminum alloy, or more, after achieving the strengthening described (precipitation-hardening) in the first phase as mentioned hereinbefore. In some embodiments, the second phase can be considered accomplished when the desired degree of corrosion resistance is achieved and the temperature is suitably lowered for third phase precipitation-hardening. However, in some cases, the corrosion resistance can improve in the third phase such that the second phase can be shortened to a level less than the desired corrosion resistance to allow for this effect.

The alloy is then precipitation hardened in the third treatment or phase, typically, in the case of 7000-series aluminum alloy, at one or more temperatures between something above room temperature and about 325° or 330° F., typically from about 175° to 325° F. In the third phase, the aging exploits residual supersaturation to develop added strength. This precipitation-hardening step may proceed at substantially the same general level of temperature or temperatures employed in the earlier (first phase) precipitation-hardening operation. The times employed are about 2 to 30 or more hours. It is quite desirable in this third phase to utilize substantial exposures, typically for several hours, at one or more temperatures substantially below the higher (or highest) temperatures used in the second phase. During this precipitation-hardening phase, the strength of the product is increased to a very high level, above that accompanying the improved corrosion resistance achieved in the second phase and typically to the desired final yield strength level.

As can be seen from the foregoing, either or both precipitation-hardening phases and/or the intermediate higher temperature treatment can be performed at one or more temperatures by ramping up and/or down within a particular temperature range. As is generally recognized in the art, integration of aging effects under ramp-up or ramp-down conditions is useful in determining the total aging effect as described in U.S. Pat. No. 3,645,804, the disclosure of which is incorporated herein by reference.

It is preferred that the second phase treatment not be carried for time-temperature combinations excessively exceeding the extent needed to develop the desired level of corrosion resistance properties. Use of excessive time-temperature exposure in the second phase can impede the ability of the third phase to achieve the desired high level of strength. Also, it may be of advantage in some cases to rapidly cool the product after a desired amount of treatment. Such cooling can be relatively drastic, such as by water quenching (immersion or sprays), or less drastic, such as by removal from the furnace and air or forced air (fans) cooled. Some advantage to rapid cooling from the second treatment, or rapid heating at the commencement of the second phase, can arise in some cases because of improvement in control of time and temperature. Thus, while ramping-up to and/or down from a temperature (more or less gradual heat-up and cool-down) can be employed, especially if ramp-up and ramp-down effects are appropriately accounted for, nonetheless, it may be advantageous in some cases to utilize rapid heat-up and/or rapid cool-down in one or more treatment phases, for instance in the second phase.

Among the advantages achieved by the present invention, is that its aging process for precipitation hardening metal alloys provides a means by which strength and resistance to intergranular corrosion (hence the resistance to exfoliation and to SCC) can be improved simultaneously. Corrosion resistance has been substantiated, EXCO, and alternate immersion testing. Treatment according to the invention appears commercially feasible and applicable particularly in the case of 7×50 aluminum alloy plate and other 7×50 products. Thus, it has been found that plate of 7050 and 7150 aluminum alloys responded favorably to three-step aging treatments of the invention consisting, for example, of an underaged first step aging (e.g. 250° F./24 hr), a high temperature (e.g. 360° F.–375° F.) second step, followed by a third step aging similar to the first step. The resulting combination of strength and corrosion resistance is significantly better that of conventionally aged plate.

The response of product treated according to the invention is relatively insensitive to small compositional differences, the presence or absence of stretcher stress-relief, variations in second step heat-up times, and cooling rate from the second step. For instance, in the case of 7×50 plate, aging results were not affected by slight Zn, Mg and Cu composition difference in alloys 7050 and 7150, by presence or absence of stretcher stress-relief, by second step heat-up times of from 3 to 45 minutes, or by significant variations in cooling rate from the second step temperature.

Conclusions regarding the resistance to SCC of material treated according to the invention, for instance 7×50 plate, to alternate immersion SCC tests have been confirmed by results of DCB (Double Cantilever Beam) and breaking load tests and by the results of similar SCC tests in seacoast atmosphere.

A very important advantage of the invention resides in the provision of process technology achieving or surpassing previously attained strength levels at improved levels of corrosion resistance. For instance, the aging treatment of the present invention achieved the 7050-T651 strength level combined with a one letter grade improvement in EXCO exfoliation resistance rating and consistent improvement in resistance to SCC. Treatment of 7×50 material to achieve a level of resistance to exfoliation corrosion and SCC similar to that of the T7651 temper resulted in a strength increase of between 5.7 ksi and 10.2 ksi, average 8.5 ksi, which is a 12% improvement in strength. Similarly, as much as 10.1 ksi or 15% improvement in strength with respect to T7451 appear possible through the aging treatment of the invention.

In the case of 7×50 aluminum alloy, there is no sacrifice in the fracture toughness/yield strength relationship as compared with conventional aging.

EXAMPLES

Further illustrative of the invention are the following examples.

In General

In the examples the following applies in general.

In all aging treatments discussed below, heating rate and temperature were monitored by insertion of iron-constant thermocouples in mid-thickness of samples. All temperatures are to ±2° F.

Aging practices for standard "T" tempers of aluminum alloys can be found in:

1. MIL-H-6088E of the United States Department of Defense, and
2. Tempers for Aluminum and Aluminum Alloy Products Registered with the Aluminum Association, by the Aluminum Association, Washington, D.C., Sep. 1, 1984.

Unless indicated otherwise, tests herein were done as follows:

1. Stress Corrosion Cracking (SCC) Alternate Immersion Test:

To determine stress-corrosion resistance, short-transverse, ⅛inch (3.2 mm) diameter specimens were stressed in constant strain fixtures. The fixtures are described in ASTM Standard G44-75. Both the control and test specimens were exposed by an alternate immersion test comprising ten minutes immersion in 3.5% aqueous NaCl solution and a 50-minute drying cycle. Stresses were maintained constant ksi (kilopounds per square inch) values throughout the tests.
2. EXCO Test:

ASTM Standard G34-72.
3. Toughness Test:

Standard Test Method for Plain Strain Fracture Toughness of Metallic Materials, ASTM-E399.
4. Tensile Test:

Standard Method of Tension Testing for Wrought and Cast Aluminum and Magnesium Alloy Products, ASTM-B557.
5. Electrical conductivity (EC) values were determined as % of International Annealed Copper Standard (IACS), using a Magnaflux FM100 Eddy Current Conductivity Meter.

EXAMPLE SET I

In this set of examples, 0.92 in. thick 7150 alloy (composition as set forth in Table I), in the form of solution heat treated plate, was in accordance with the invention subjected to an underaged first step of 225° F. or 250° F. for 24 hours, second step of soak at 375° F. for 30–90 minutes (rapidly brought to the prescribed soaking temperature −3 min. heating time) followed by water quenching and third step aging at 250° F. for 24 hours. All aging experiments were carried out in air furnaces. The plate was obtained by re-solution heat treating plant produced 7150-T651 plate, quenching and aging in accordance with the invention.

Electrical conductivity, longitudinal tensile properties and EXCO ratings were obtained for the samples treated according to the invention. For comparison with conventional tempers, a T6-type aging curve was generated, along with standard T76 and T74 (formerly T736) tempers. Table III and FIG. 1 present the longitudinal yield strength, electrical conductivity and exfoliation data generated in Set I. The advantage of the invention for improved combinations of strength and exfoliation performance is clear. When the plate is treated by the invention to the T6 strength level, about 2% IACS higher EC is observed relative to conventional aging.

EXAMPLE SET II

Figures 2A, 2B, 2C, 2D:
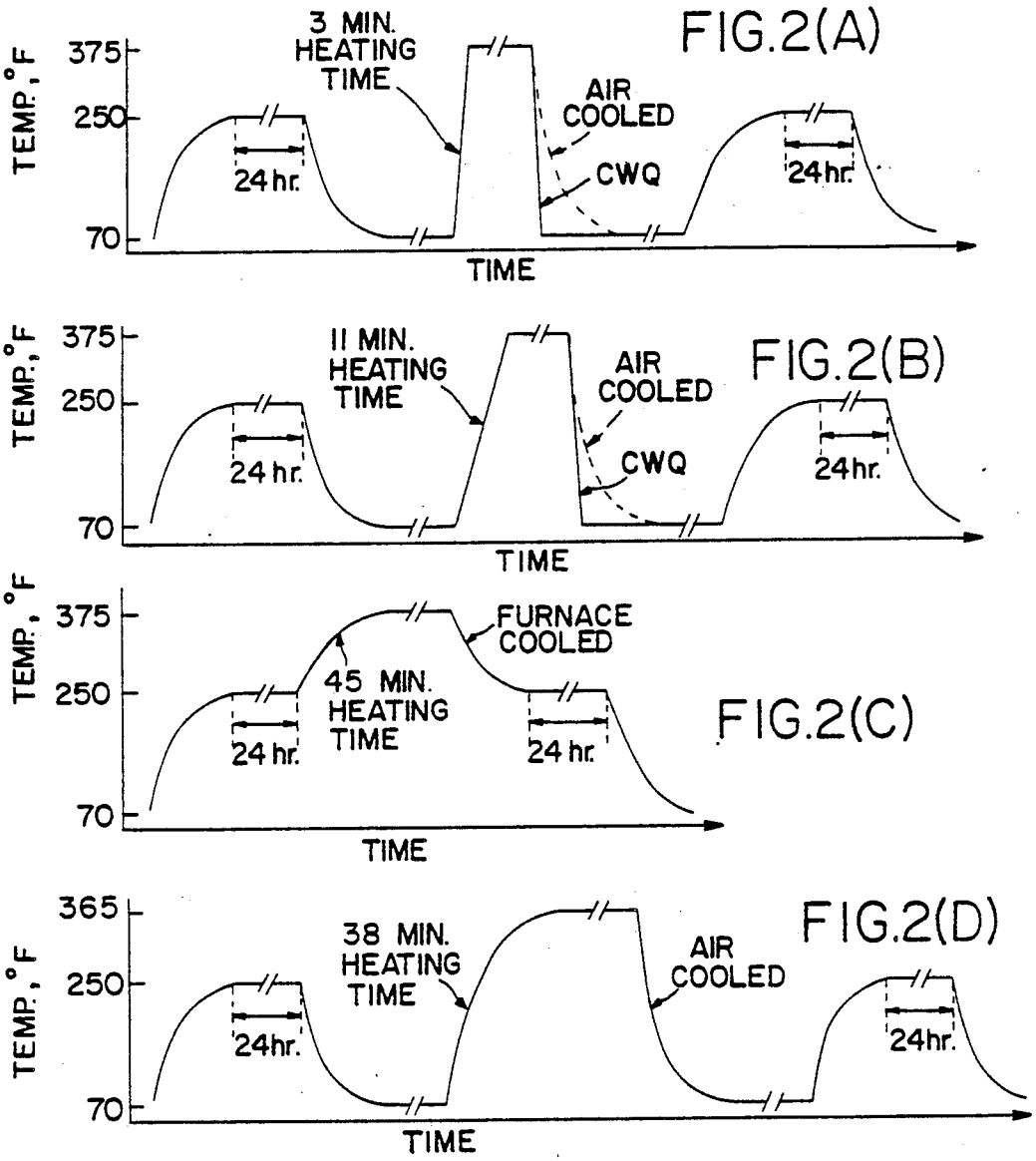
FIG. 2 is a graphical representation of four aging regimes of the invention for 0.965 in. 7150 plate.

Four different lots of 0.965 in. thick 7150 plate were solution heat treated, spray quenched and stretched. Each lot was given a different regime of aging treatment in accordance with the invention, and standard tempers were generated from each lot to address the issue of lot-to-lot variability. All aging treatments involved a first and third step of 250° F. for 24 hours. The second step was varied in four ways and all treatments were carried out in air furnaces. The four regimes are depicted in FIG. 2 and detailed below. The term "discontinuous" refers to the specimens reaching room temperature between the steps; such appears in FIGS. 2A, 2B, and 2D. In the "continuous" example shown in FIG. 2C, movement is from one temperature directly to the next, without interposition of a room temperature residence.

In the regime shown in FIG. 2A, samples were first step aged at 250° F. for 24 hours and air cooled to room temperature. Using a 1000° F. heatup furnace, they were heated essentially up to the 375° F. second step in 3 minutes (as determined by a thermocouple in the center of the specimen), then transferred to a holding furnace operating at 375° F. and held for 30–120 minutes and water quenched. In addition to water quenching, the DSA-60 (For brevity, a DSA treatment of (250° F./24 hr +375° F./X min +250° F./24 hr) will be referred to as DSA-X; thus, DSA-60 represents 60 minutes at 375° F.) condition of the invention also was air cooled from 375° F. All samples were subsequently third step aged at 250° F. for 24 hours and air cooled.

In the regime as shown in FIG. 2B, all experimental conditions were exactly the same as in "A" except for the use of a different heating rate to the second step. A 500° F. heatup furnace was used which gave an 11 minute heatup time to 375° F.

In the regime of FIG. 2C, a programmable air furnace was used. Upon completion of the first step of 250° F. for 24 hours, the furnace temperature was raised to 375° F. in 45 minutes on a logarithmic time scale. After holding at 375° F. for 30–180 minutes, samples were immediately transferred to another furnace already stabilized at 250° F. and held for 24 hours. Hence, this continuous aging regime does not involve transition to room temperature between first and second and second and third step aging treatments.

In the regime shown in FIG. 2D, samples were given the first step treatment of 250° F. for 24 hours and air cooled to room temperature. Then they were placed in a 365° F. furnace and heated to temperature in 38 minutes. Upon soaking for 30–60 minutes, they were transferred to a 250° F. furnace, held for 24 hours and then air cooled.

Tensile properties, electrical conductivity and EXCO ratings were obtained for all examples of the invention and standard tempers. Selected samples from regime "B" (discontinuous, 11 minute heating time to 375° F.) were evaluated for plane strain fracture toughness ($K_{Ic}$) and for resistance to SCC by alternate immersion using C-rings (0.75 in. OD and length, 0.060 in. thickness) stressed to 35 and 45 ksi with five replicates for each stress level. DSA-60 was evaluated for resistance to fatigue crack growth.

Figure 3A:
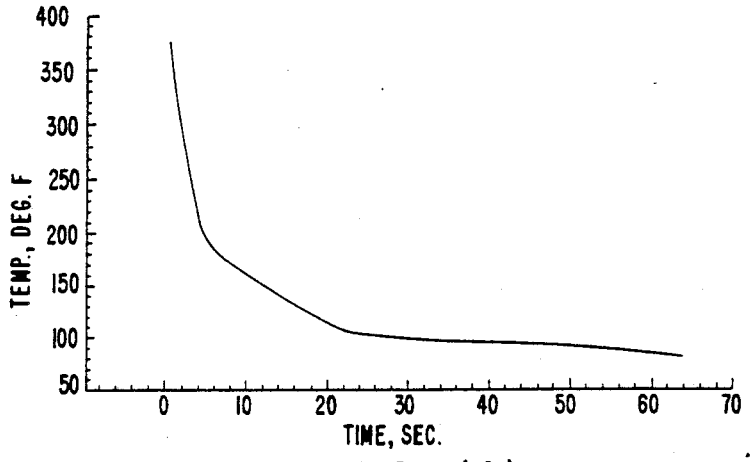
FIG. 3 presents cooling curves from 375° F. (See FIG. 2).

The second step heating rates (70° F.–375° F.) for regimes (A) and (B) (see FIG. 2) were substantially linear, and those for regimes (C) (250° F.–375° F.) and (D) (70° F.–375° F.) were substantially logarithmic. The second step cooling curves for cold water quenching (375° F.–80° F.), air cooling (375° F.–80° F.) and furnace cooling (375° F.–250° F.) are presented in FIGS. 3*a*, *b* and *c*, respectively.

The DSA practice of the invention and standard practices plus the corresponding electrical conductivity (EC), longitudinal tensile properties, EXCO ratings and weight loss for regimes (A), (B), (C) and (D) are given in Tables IV, V, VI and VII. These data are plotted (except weight loss) in FIGS. 4, 5, 6 and 7, respectively. Also given in Table V are SCC and $K_{Ic}$ data for regime (B) (discontinuous, 11 minutes to 375° F.). The latter is plotted in FIG. 8 as a function of yield strength. Evaluation for resistance to fatigue crack growth (da/dN) showed DSA-60 to be comparable, but somewhat better, than T651.

Figure 4:
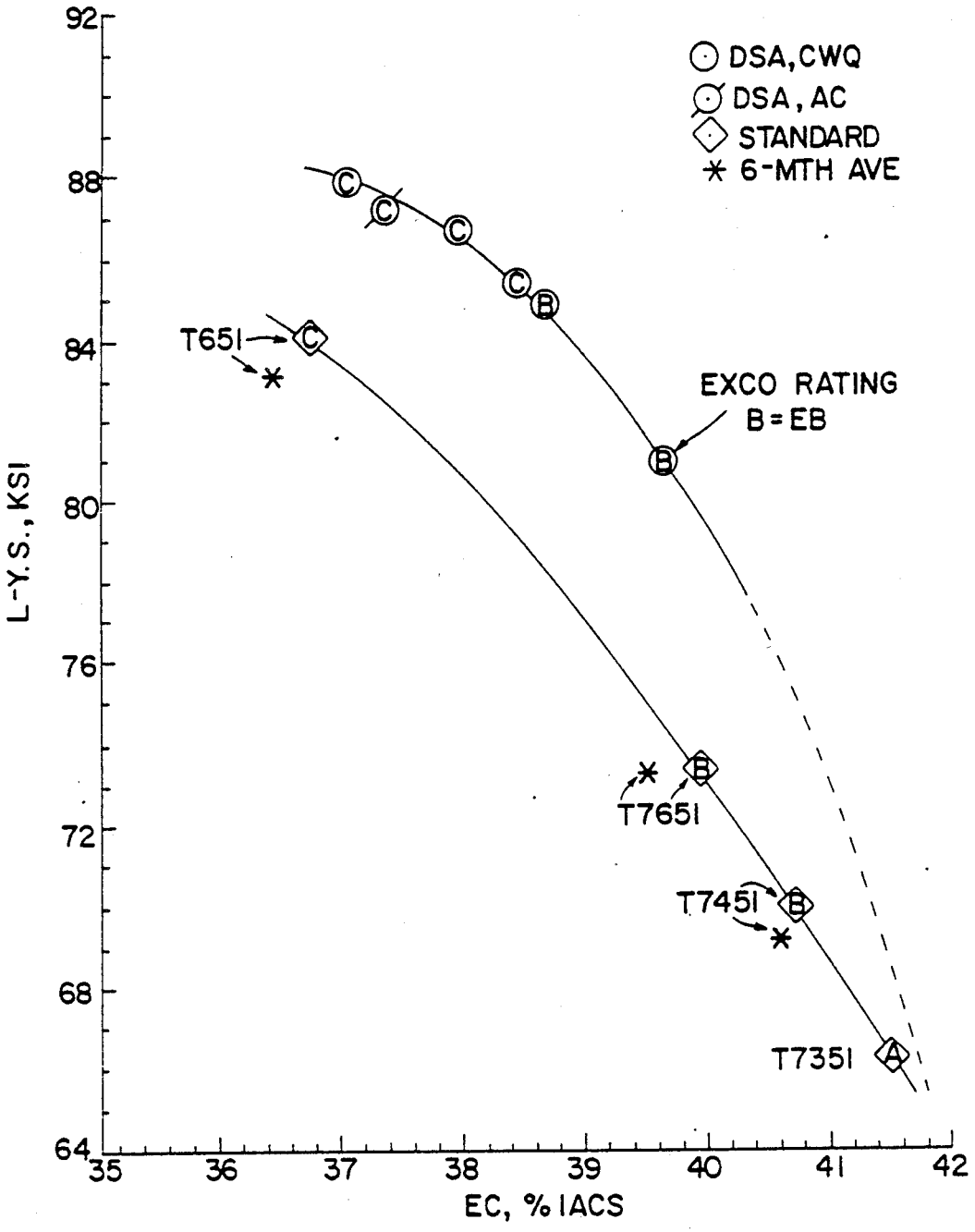
FIG. 4 provides L-YS vs. EC for the invention and standard tempers, discontinuous, 3 min. to 375° F. (See FIG. 2A).
Figure 5:
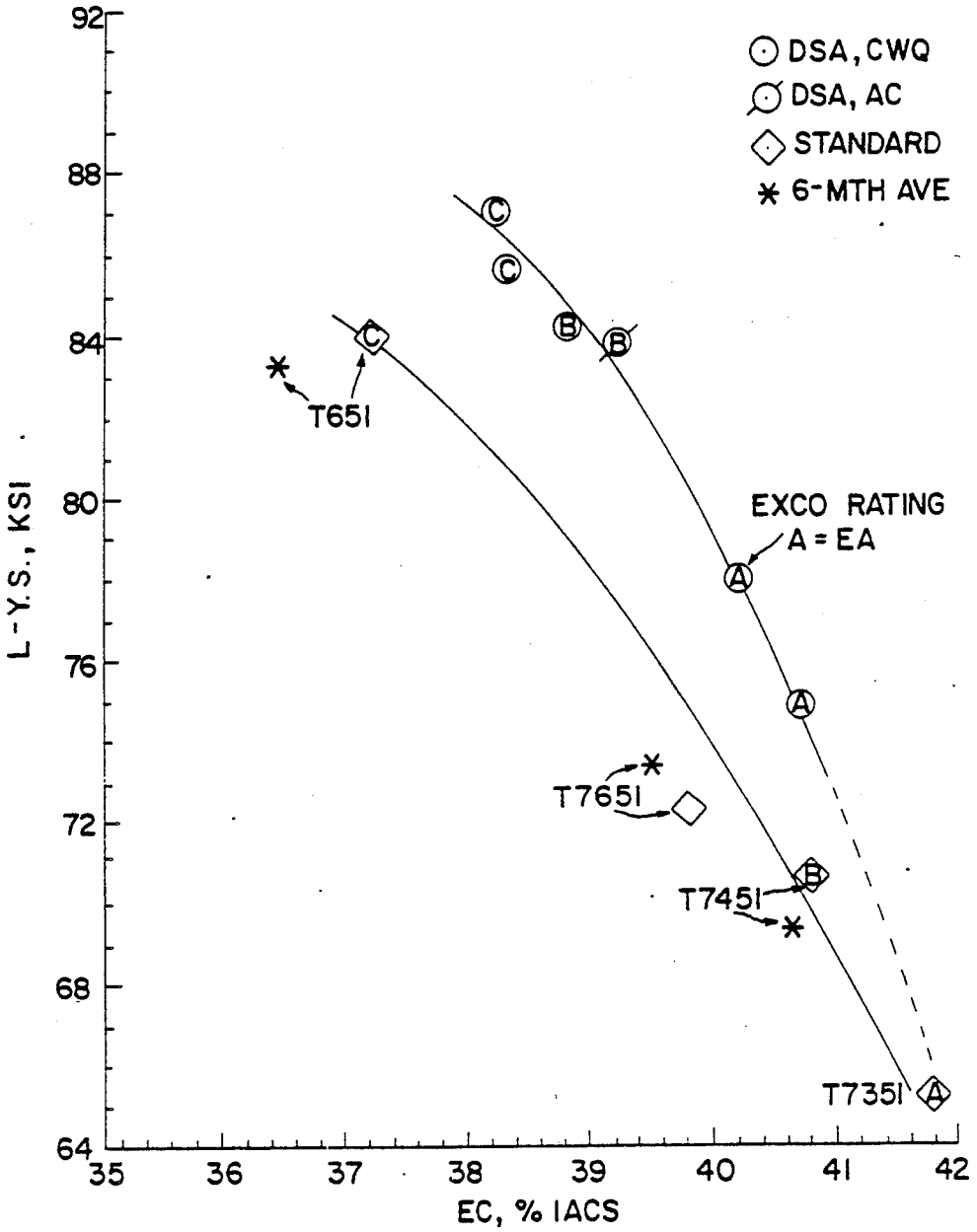
FIG. 5 presents L-YS vs. EC for the invention and standard tempers, discontinuous, 11 min. to 375° F. (See FIG. 2B).
Figure 6:
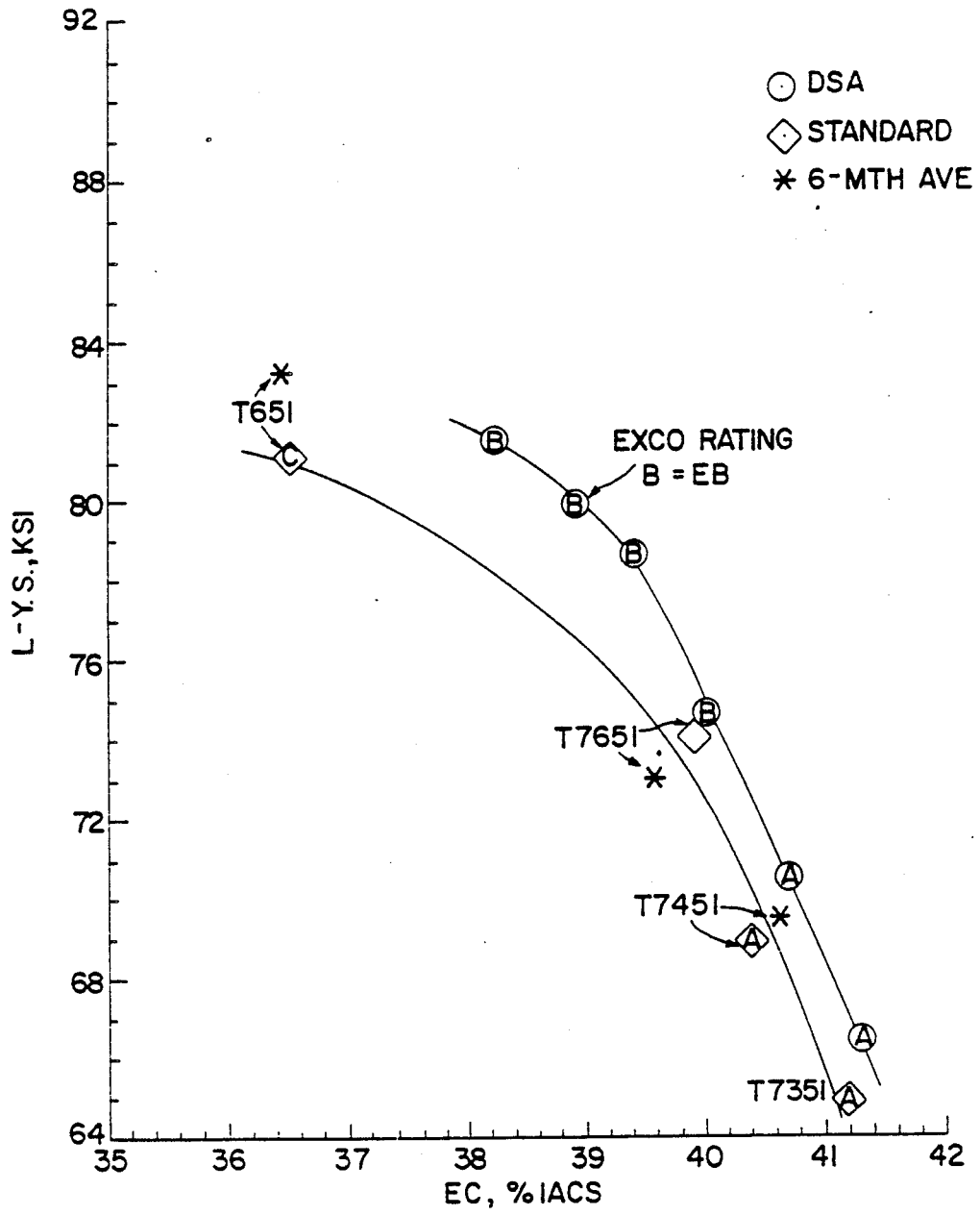
FIG. 6 gives L-YS vs. EC for the invention and standard tempers, continuous, 45 min. to 375° F. (See FIG. 2C).
Figure 7:
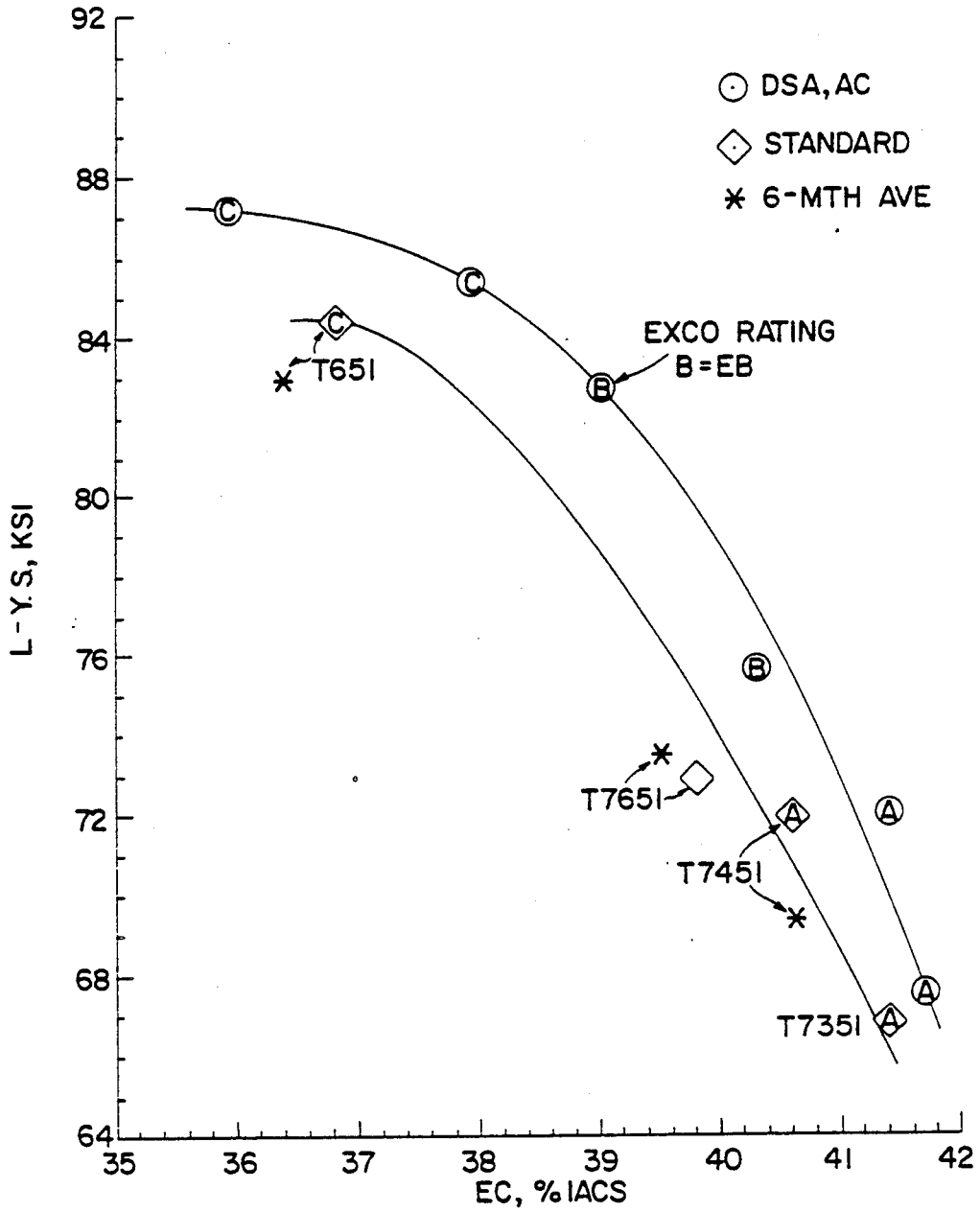
FIG. 7 is L-YS vs. EC for the invention and standard tempers, discontinuous, 38 min. to 365° F. (See FIG. 2D).

Examination of FIG. 4 shows the DSA tempers of the invention exhibit a displaced strength/EC relationship with respect to the standard tempers aged from the same production lot. The DSA and standard tempers can be compared in two manners: (a) conductivity and EXCO rating for a particular strength level of interest, and (b) strength at the conductivity or EXCO rating of interest. For example, a horizontal line at 84 ksi first intersects the "standard tempers" at 36.7% IACS with an EXCO rating of EC. The intersection at the same strength level of 84 ksi with the "DSA tempers" occurs at 38.8% IACS, with an EXCO rating of EB. Hence, treatment according to the invention results in one grade improvement (EC to EB) in EXCO rating at T6 strength for this lot of material. Alternatively, for a vertical line at a conductivity of 39.8% IACS, the invention shows an advantage of 6 ksi strength with the same EXCO rating of EB.

As shown in FIGS. 4 to 7 and Tables IV to VII, the four different regimes all show that the strength/EC relationship for the material of the invention is displaced towards higher EC and higher strength. This is accompanied by an improvement in EXCO rating with respect to the standard tempers, FIGS. 7 through 11. A larger displacement is observed at low EC (where supersaturation is still high) and the displacement diminishes at high EC (where overaging has taken place).

This displacement of strength/EC relationship along with improvement in EXCO rating is quite similar for heating times from 3 minutes to 38 minutes to the second step temperature (see FIGS. 4 to 7). Even the continuous DSA treatment had the similar displacement when compared to the standard tempers aged from the same lot.

Material treated according to the invention to the T651 strength level consistently shows an improvement in EXCO rating similar to the rating for conventional T7651 plate as shown in FIGS. 4 through 7.

Figure 8:
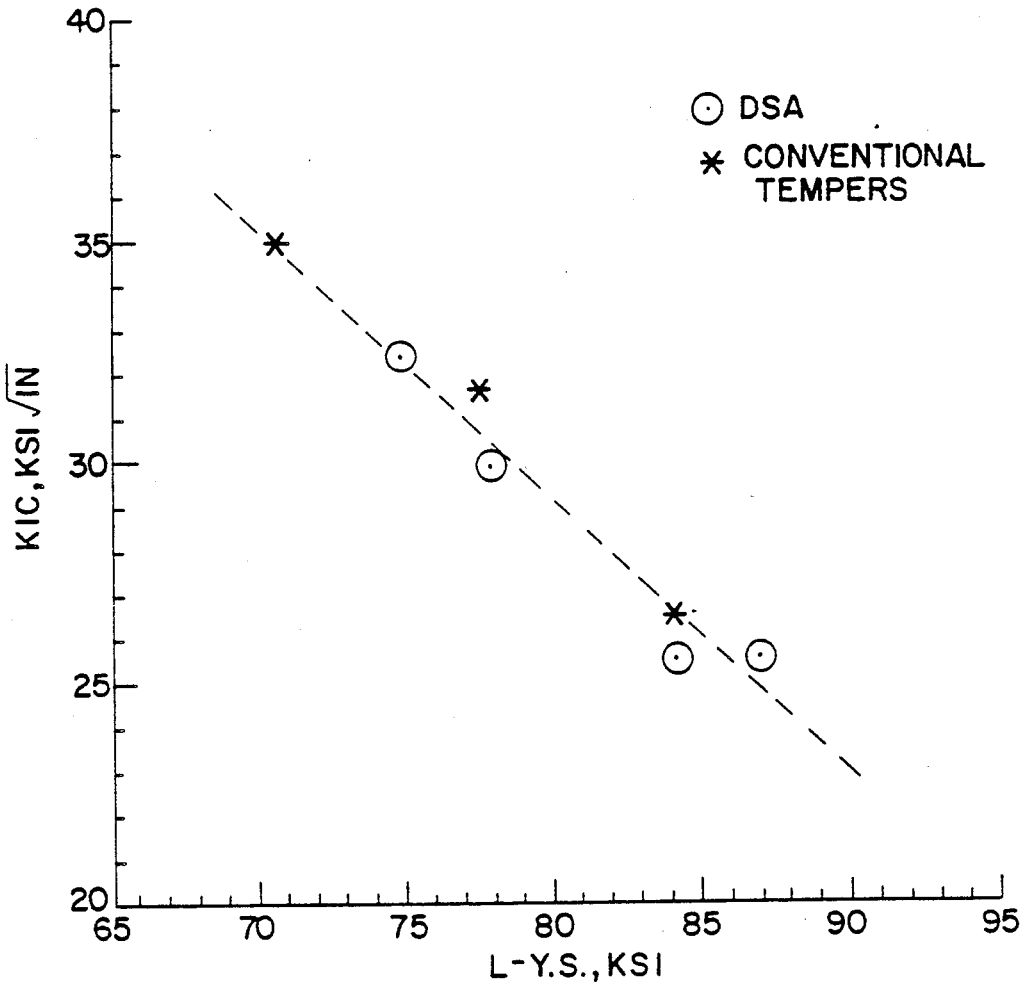
FIG. 8 is a chart of S-L (Short-transverse directional load, Longitudinal direction of crack propagation) $K_{Ic}$ (measure of toughness) vs. L-YS for the invention and standard tempers, discontinuous, 11 min. to 375° F. (See FIG. 2B).

Both DSA-type and standard tempers possess the same $K_{Ic}$-yield strength relationship as shown in Table V and FIG. 8, it bearing repeating that for a given strength-toughness level the DSA material exhibits better corrosion resistance.

Conventional aging beyond peak strength typically results in overaging, characterized by EC increase and strength loss. In the invention, the third step can result in an EC increase of about 0.6–1.1% IACS, but is always accompanied by a strength increase. This suggests the precipitation of a strengthening phase(s) more than compensates for any loss in strength that could be caused by concomitant coarsening or overaging during the third step. The effect of the third step on EC and strength should be dependent on the microstructure and the residual supersaturation after the second step.

EXAMPLE SET III

Procurement of plant fabricated, heat treated and stretched 1.5 in. thick 7050-W51 plate as the starting material permitted the use of short-transverse tensile specimens in alternate immersion SCC tests to determine SCC resistance.

Figure 3B:
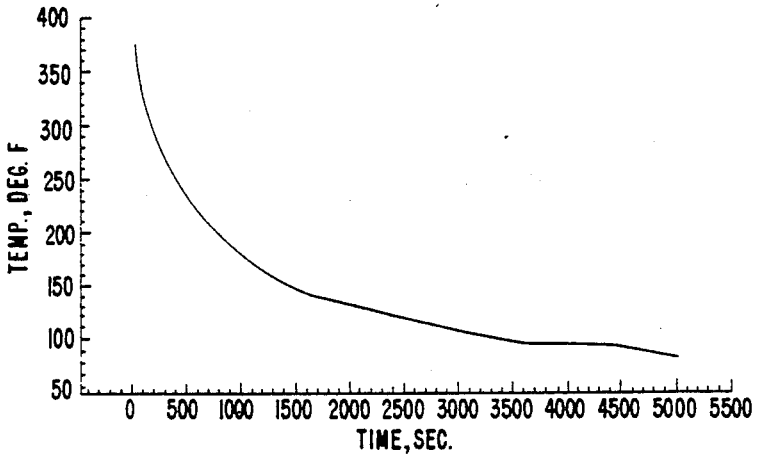
Figure 3C:
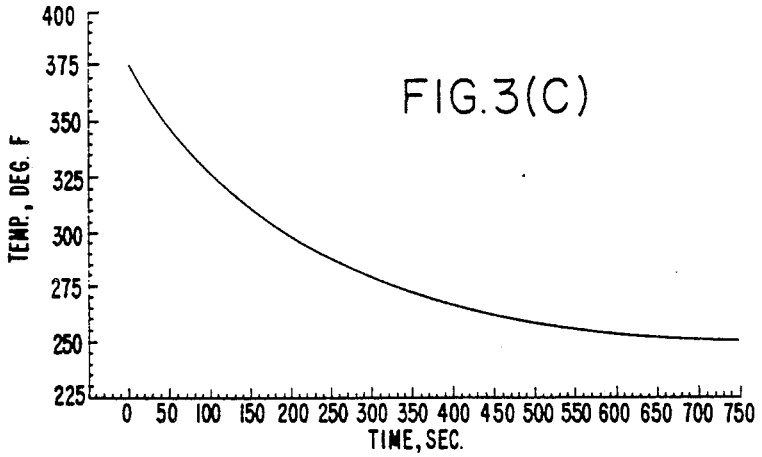

The type of treatment of the invention employed in these examples comprised first step underaging in an air furnace at 250° F. for 24 hours, air cooling, second step aging in an electrically heated oil bath (Dow Corning 200 fluid) at 375° F. for 15–180 minutes, air cooling and third step aging at 250° F. for 24 hours. The second step heatup time from 70°–375° F., following immersion of the 4-inch wide by 8-inch long by 1.5-inch thick sample into the oil bath was 7 minutes (temperature was considered to have been achieved when the thermocouple read to within 5° F. of 375° F., in view of the asymptotic character of the approach to temperature) in a logarithmic manner. A motorized agitator was placed at the bottom of the bath to ensure temperature uniformity. Drop in bath temperature was less than 2° F. Cooling from 375° was by air cooling which is expected to be similar to previously experienced cooling rate shown in FIG. 3*b*.

As before, conventional tempers were produced for comparison. Those were T651, T7651, T7451 and T7351 tempers. Longitudinal tensile properties, EXCO ratings and weight losses were obtained for all DSA and conventional tempers. In addition, the following tests were performed to evaluate the resistance to SCC of selected material conditions:

(1) 30-day alternate immersion (ASTM G44-75) in 3.5% NaCl solution at stresses of 35 and 45 ksi using short-transverse 0.125 in. dia. tensile specimens with 5 replicates per stress level.

(2) One-year exposure to seacoast atmosphere at Point Judith, R.I., of short-transverse tensile specimens stressed at 35 and 45 ksi, 5 replicates per stress level.

(3) Breaking load test of samples subjected to AI stressed at 0, 25, 35, and 45 ksi exposed for 0, 2, 4 and 6 days with 5 replicates per condition.

In addition, coupons were exposed at Point Judith for one year to evaluate resistance to exfoliation.

The chemical composition of the plate material used in this set of examples was within Aluminum Association limits for 7050. See Table II.

Figure 9:
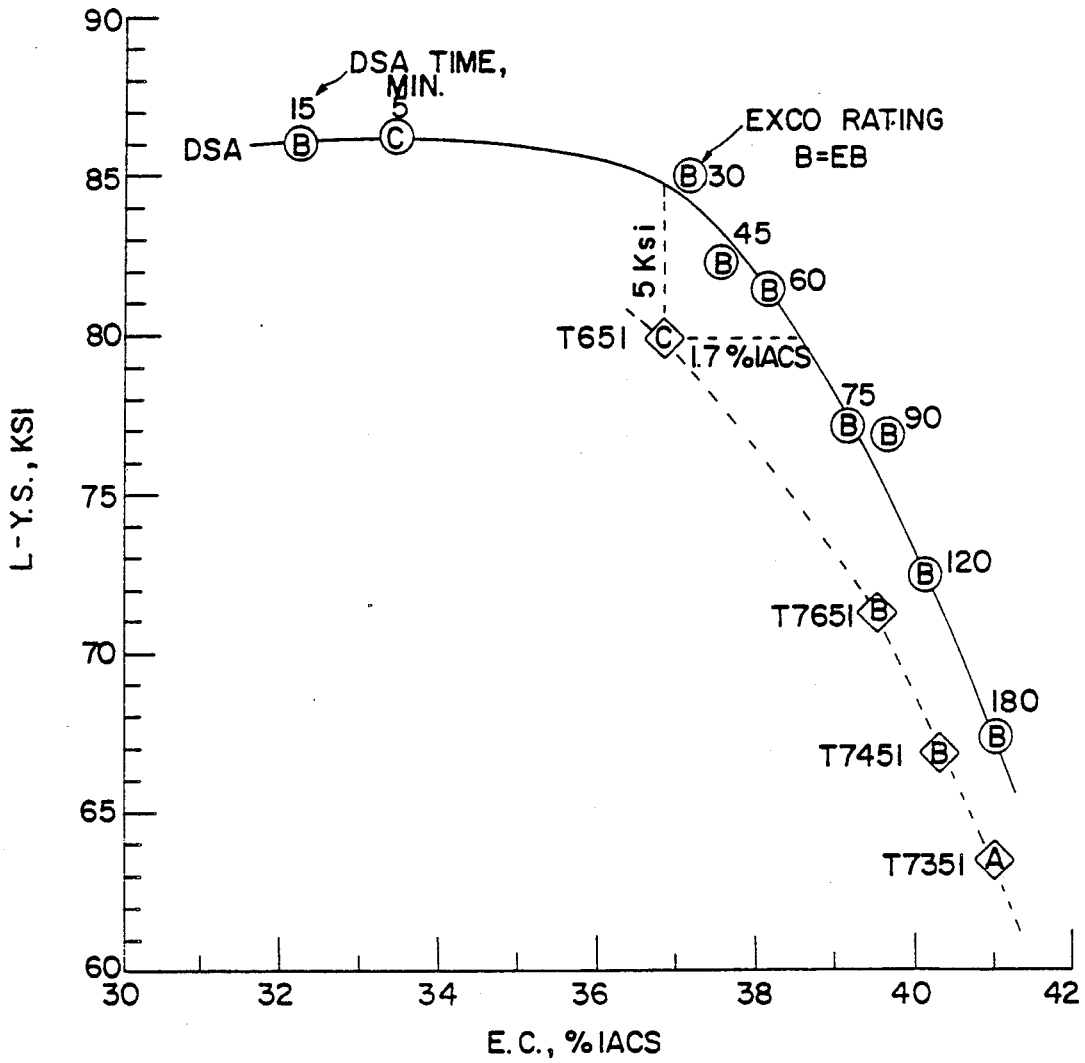
FIG. 9 is for the invention of 1.5 in. plate, L-YS vs. EC, including exfoliation ratings, compared to standard tempers.

L-YS and EC results are listed in Table VIII and plotted in FIG. 9. As in the previous set of examples, the DSA curve of the invention in FIG. 9 is shifted towards higher strength and EC with respect to the conventional aging curve. At the T651 strength level, the aging treatment of the invention results in 1.7% IACS higher EC, and, at the same EC as T651, aging according to the invention yields about a 5 ksi strength advantage. At the T7651 strength level, the EC increase through the invention is reduced to about 0.8% IACS, but, at the same EC as T7651, the 5 ksi strength advantage through the invention is maintained. Similar comparisons may be made for other tempers.

EXCO ratings and weight loss results are contained in Table VIII. EXCO ratings and DSA times are superimposed on the L-YS versus EC plot in FIG. 9 and the L-YS versus weight loss plot in FIG. 10.

Figure 10:
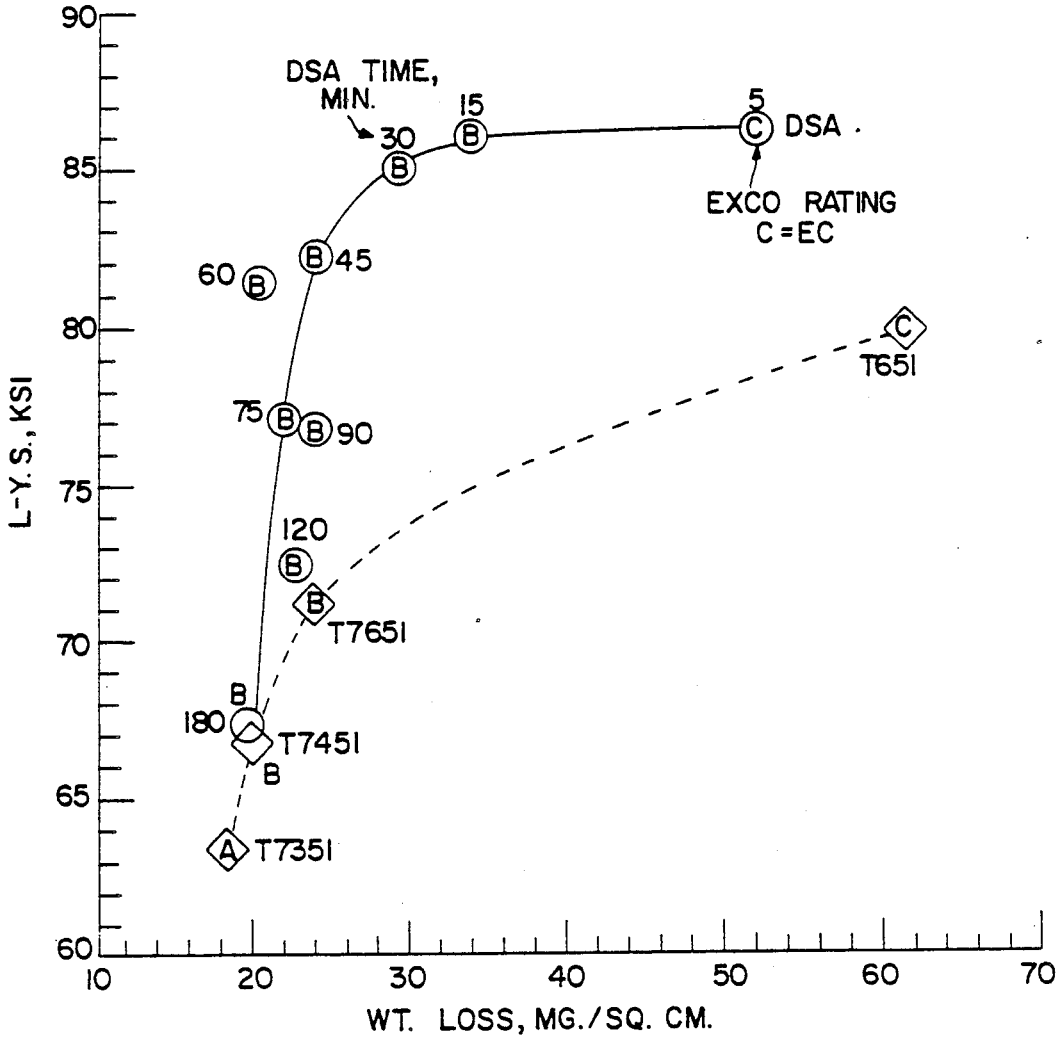
FIG. 10 charts results of the invention applied to 1.5 in. plate in terms of L-YS vs. wt. loss, compared to standard tempers.
Figure 11A:
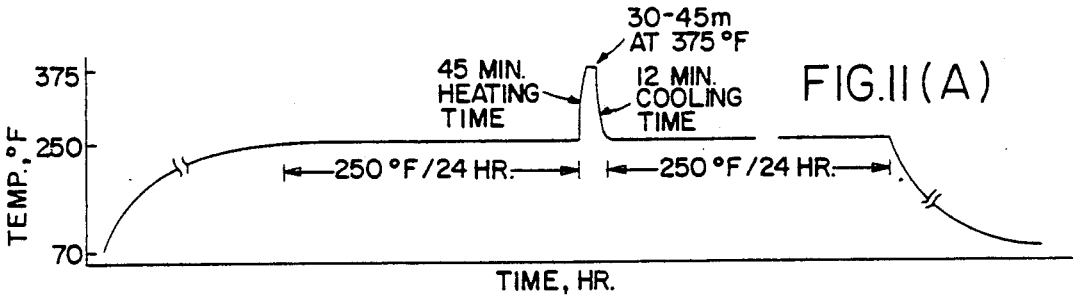
FIG. 11 is a schematic presentation of temperature-time plots.
Figure 11B:
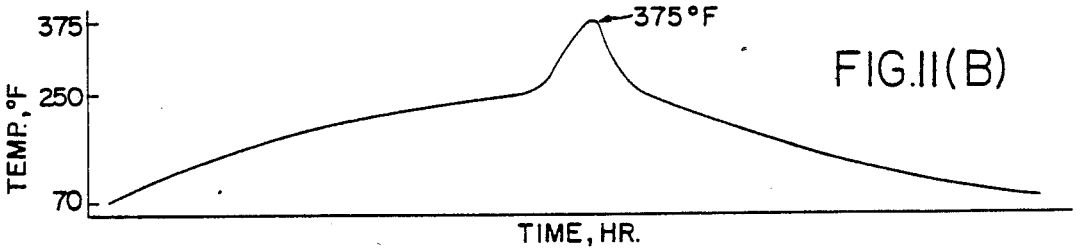
Figure 11C:
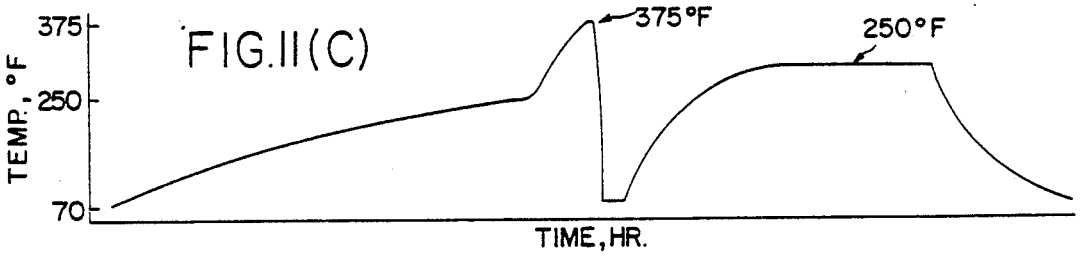
Figure 11D:
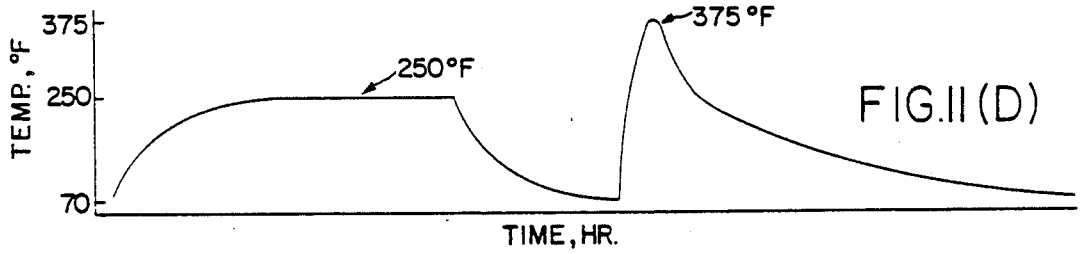

Although the DSA-5 plate is equally susceptible to exfoliation corrosion as the T651 plates, the DSA-5 plate has a 6 ksi L-YS strength advantage. Both of these plates were rated EC in the EXCO test and had high weight loss (difference in weight per unit exposed area between unexposed sample and exposed condition of the same sample with corrosion products removed), as shown in FIGS. 9 and 10 and Table VIII. Material given DSA-15 and DSA-30 treatments exhibited distinctly improved exfoliation resistance relative to the T651 plate along with a 5–6 ksi strength increase; EXCO rating was improved from EC to EB and the corresponding weight loss from about 60 mg/cm$^2$ to about 30 mg/cm$^2$. It should be noted that one letter grade improvement in EXCO rating is quite significant due to the coarseness of the rating scale, as is evident from the reduction in weight loss (FIG. 10).

At an exfoliation performance level comparable to T7651 as measured by EXCO rating and weight loss, about a 10 ksi strength advantage is possible through the DSA treatment of the invention, e.g., DSA-45 and DSA-60 (FIG. 10).

The shapes of the two curves in FIG. 10 are of interest. It appears that for both DSA and standard aging schemes, weight loss dramatically increases above a critical strength level with concomitant degradation in EXCO rating. This critical strength is of the order of 85 ksi for DSA, but only about 75 ksi or less for standard aging.

The 30-day AI SCC test results are presented in Table IX.

The results of 30-day AI SCC test in this study show that T651, DSA-5 and DSA-15 all are quite susceptible to SCC under sustained stress levels of 35 and 45 ksi. All samples of these three conditions failed within 3 days of exposure. DSA-60 (YS =81.4 ksi) compares favorably with T651 (YS =79.9 ksi): with 1.5 ksi strength advantage, it is more resistant to SCC. The T7651 plate (YS =71.2 ksi) is intermediate in performance with respect to DSA-60 and DSA-90 (YS =76.9 ksi), suggesting that aging according to the invention results in a strength advantage of between 5.7 ksi and 10.2 ksi at a SCC resistance level comparable to T7651. L-YS versus days to first failure of 5 replicates stressed at 45 ksi leads to a similar conclusion: With a level of resistance of SCC comparable to T7651, DSA results in 8.5 ksi strength advantage, which is a 12% improvement in strength. The AI results also indicate that the difference in performance between T7451 and DSA-90 conditions is not statistically significant: both tempers show a high level of SCC resistance. However, in comparison with T7451, DSA-90 is 10.1 ksi higher in YS, which is a 15% improvement in strength.

One year of exposure to seacoast atmosphere at Point Judith was completed and substantiated the strength improvement of DSA-90 compared with T7651 Results as of somewhat over three months are presented in Table VIII, and are in agreement with the 30-day accelerated AI SCC test results.

The breaking load results are presented in Table IX. The breaking load data support the conclusion that treatment according to the invention provides increased strength at the same or improved resistance to SCC.

In defining the present invention, it has been divided into three phases or steps for the sake of convenience. The phases may in practice merge with one another. For instance, the first and second phases, all three phases, or the second and third phases may merge to form a single phase. These ideas are illustrated in FIG. 11. Consider, for instance, FIG. 11(*a*), representing FIG. 2(C), one of the proven successful processing routes. All three steps were carried out continuously without cooling down to room temperature. In short, the entire procedure may be described as [L+H+L], where "L" and "H" mean "low" and "high", respectively. By smoothing the transitions between L, H and L, which is readily done in a programmable furnace, these three steps can be made to appear as a one-step process, while still containing the essence of all three stages. This situation, [LHL], is shown in FIG. 11(*b*). Similarly, an apparent two-step treatment by combining L and H and keeping the final step separate, the situation of [LH+L], is possible, FIG. 11(*c*). Of course, another two-step procedure, [L+HL], as shown in FIG. 11(*d*), is just as easily done.

What is claimed is:

1. An aging process for solution-heat-treated, precipitation hardening metal alloy, comprising the steps of aging the alloy to a point substantially below peak yield strength to form a uniform, fine distribution of islands of increased concentration of alloying elements, subsequently aging the alloy at a higher temperature or temperatures for increasing the stability of the islands and for moving elements to the islands to decrease the electrochemical difference between grain boundaries and grain interiors, and thereafter aging the alloy at one or more temperatures below said higher temperatures for exploiting residual supersaturation to develop added strength.

2. An aging process as claimed in claim 1, the alloy being an aluminum alloy.

3. An aging process as claimed in claim 2, the aluminum alloy being a 7000-series aluminum alloy.

4. An aging process as claimed in claim 3, the aluminum alloy being a 7×50 alloy.

5. An aging process as claimed in claim 2, said point being at least 3 ksi below peak yield strength.

6. An aging process as claimed in claim 5, said point being at least 4 ksi below peak yield strength.

7. An aging process as claimed in claim 6, said point being at least 5 ksi below peak yield strength.

8. An aging process as claimed in claim 7, said point being at least 6 ksi below peak yield strength.

9. An aging process as claimed in claim 1, both yield strength and resistance to intergranular corrosion being improved by the process.

10. An aging process as claimed in claim 1, the process providing at least, or better than, T6 yield strength combined with T7 corrosion resistance.

11. An aging process as claimed in claim 4, the aging step at a higher temperature or temperatures being carried out at or above about 330° F., the aging steps for forming the islands and exploiting residual supersaturation being carried out below about 330° F.

12. An aging process as claimed in claim 11, the aging steps for forming the islands and exploiting residual supersaturation being carried out below about 295° F.

13. An aging process for solution-heat-treated, precipitation hardening 7×××-type aluminum alloy, comprising (1) aging the alloy at one or more temperatures substantially above room temperature but below about 325° F. to substantially below peak yield strength, (2) subsequently aging the alloy at one or more temperatures of about 330° F. for higher for increasing resistance of the alloy to corrosion, and thereater (3) aging the alloy at one or more temperatures substantially above room temperature but below about 325° F. for increasing yield strength.

14. An aging process as claimed in claim 13, the aluminum alloy consisting essentially of about 5.7 to 6.9% Zn, about 1.9 to 2.7% Mg, about 1.9 to 2.6% Cu, about 0.08 to 0.18% Zr, balance substantially aluminum and incidental elements and impurities.

15. An aging process as claimed in claim 13, wherein, in said recitation (1), said aging is to 3 ksi or more below peak yield strength.

16. An aging process as claimed in claim 13, wherein, in said recitation (1), said aging is to 4 ksi or more below peak yield strength.

17. An aging process as claimed in claim 13, wherein, in said recitation (1), said aging is to 5 ksi or more below peak yield strength.

18. An aging process as claimed in claim 13, wherein, in said recitation (1), said aging is to 6 ksi or more below peak yield strength.

19. An aging process as claimed in claim 13, both yield strength and resistance to intergranular corrosion being improved by the process.

20. An aging process as claimed in claim 13, the process providing at least, or better than, T6 yield strength combined with T7 corrosion resistance.

21. An aging process for an aluminum alloy containing about 5.7 to 6.9% Zn, about 1.9 to 2.7% Mg, about 1.9 to 2.6% Cu, and about 0.08 to 0.18% Zr, said process comprising:

(1) aging the alloy at one or more temperatures within about 175° F. to 325° F. to a yield strength below peak yield strength by 4 ksi or more;

(2) aging the alloy at one or more temperatures above about 330° F. to increase the alloy's resistance to corrosion; and (3) aging the alloy at one or more temperatures within about 175° to 325° F. to increase the alloy's strength.

22. An aging process as claimed in claim 21 wherein said recitation (2) aging is within about 360° to 400° F. for about 5 minutes to three hours.

23. An aging process for solution-heat-treated, precipitation hardening 7×××-type aluminum alloy, comprising (1) aging the alloy at one or more temperatures substantially above room temperature but below about 325° F. to a yield strength below peak yield strength by about 3 ksi or more, (2) aging the alloy at one or more temperatures of about 330° F. or higher for at least 3 minutes but not more than 3 hours cumulative time at temperatures of 330° F. or higher, and (3) aging the alloy at one or more temperatures above room temperature but below 325° F. for about 2 hours or more.

24. An aging process for solution-heat-treated, precipitation hardening 7×××-type aluminum alloy, comprising (1) aging the alloy at one or more temperatures within about 175° F. to about 325° F. to a strength substantially below peak yield strength, (2) aging the alloy at one or more temperatures of at least about 330° F. but less than 500° F. for about 4 minutes to about 3 hours cumulative time at temperatures of 330° F. or higher, and (3) aging the alloy at one or more temperatures within about 175° F. to about 325° F. for about 2 hours or more.

25. An aging process as claimed in claim 24, the aluminum alloy consisting essentially of about 5.7 to 6.9% Zn, about 1.9 to 2.7% Mg, about 1.9 to 2.6% Cu, about 0.08 to 0.18% Zr, balance substantially aluminum and incidental elements and impurities.

26. An aging process as claimed in claim 24, wherein, in said recitation (1), said aging is to 3 ksi or more below peak yield strength.

27. A process for aging an aluminum alloy consisting essentially of about 5.7 to 6.9% Zn, about 1.9 to 2.7% Mg, about 1.9 to 2.6% Cu, about 0.08 to 0.18% Zr, balance substantially aluminum and incidental elements and impurities, comprising (1) aging the alloy at one or more temperatures within about 175° F. to about 325° F. for about 2 hours or more to a strength at least 3 ksi below peak yield strength, (2) aging the alloy at one or more temperatuares of at least about 330° F. but less than 500° F. for about 4 minutes to about 3 hours cumulative time at temperatures of 330° F. or higher, and (3) aging the alloy at one or more temperatures within about 175° F. to about 325° F. for about 2 hours or more.

28. A product produced by the process of claim 1.
29. A product produced by the process of claim 13.
30. A product produced by the process of claim 21.
31. A product produced by the process of claim 23.
32. A product produced by the process of claim 24.
33. A product produced by the process of claim 27.
34. A product produced by the process of claim 2.
35. A product produced by the process of claim 3.
36. A product produced by the process of claim 4.
37. A product produced by the process of claim 5.
38. A product produced by the process of claim 6.
39. A product produced by the process of claim 7.
40. A product produced by the process of claim 8.
41. A product produced by the process of claim 9.
42. A product produced by the process of claim 10.
43. A product produced by the process of claim 11.
44. A product produced by the process of claim 12.
45. A product produced by the process of claim 14.
46. A product produced by the process of claim 15.
47. A product produced by the process of claim 16.
48. A product produced by the process of claim 17.
49. A product produced by the process of claim 18.
50. A product produced by the process of claim 19.
51. A product produced by the process of claim 20.
52. A product produced by the process of claim 22.
53. A product produced by the process of claim 25.
54. A product produced by the process of claim 26.

* * * * *

US005108520C1

(12) REEXAMINATION CERTIFICATE (4771st)

United States Patent

Liu et al.

(10) Number: US 5,108,520 C1

(45) Certificate Issued: Apr. 22, 2003

(54) HEAT TREATMENT OF PRECIPITATION HARDENING ALLOYS

(75) Inventors: John Liu, Lower Burrell, PA (US); Michael M. Kersker, Beverly, MA (US)

(73) Assignee: Alcoa Inc., Pittsburgh, PA (US)

Reexamination Request:
No. 90/005,957, Mar. 21, 2001

Reexamination Certificate for:

| | |
|---|---|
| Patent No.: | **5,108,520** |
| Issued: | **Apr. 28, 1992** |
| Appl. No.: | **07/365,442** |
| Filed: | **Jun. 13, 1989** |

Related U.S. Application Data

(63) Continuation-in-part of application No. 07/019,995, filed on Feb. 27, 1980, now abandoned.

(51) Int. Cl.[7] ..... C22F 1/04

(52) U.S. Cl. ..... 148/701; 148/405; 148/417; 148/698

(58) Field of Search ..... 148/405, 417, 148/697, 698, 700, 701

(56) References Cited

U.S. PATENT DOCUMENTS

| | | | | |
|---|---|---|---|---|
| 3,856,584 A | | 12/1974 | Cina | |
| 3,881,966 A | | 5/1975 | Staley et al. | |
| 4,477,292 A | | 10/1984 | Brown | |
| 4,832,758 A | | 5/1989 | Brown | |
| 4,863,528 A | * | 9/1989 | Brown et al. | 148/12.7 |

FOREIGN PATENT DOCUMENTS

| | | |
|---|---|---|
| GB | 1480351 | 7/1977 |

OTHER PUBLICATIONS

Article; "Retrogression and reaging response of 7475 aluminum alloy," *Metals Technology,* vol. 10, Oct. 1983, 7 pp.

"Investigation to Improve Stress–Corrosion Resistance of Aluminum Aircraft Alloys Through Alloy Additions and Specialized Heat Treatment", J.T. Staley, Naval Air Systems Command Contract N00019–68–C–0146 (Final Report), Feb. 28, 1969.*

* cited by examiner

*Primary Examiner*—Scott Kastler

(57) ABSTRACT

An aging process for solution-heat-treated, precipitation hardening metal alloy includes first underaging the alloy, such that a yield strength below peak yield strength is obtained, followed by higher aging for improving the corrosion resistance of the alloy, followed by lower temperature aging to strength increased over that achieved initially.

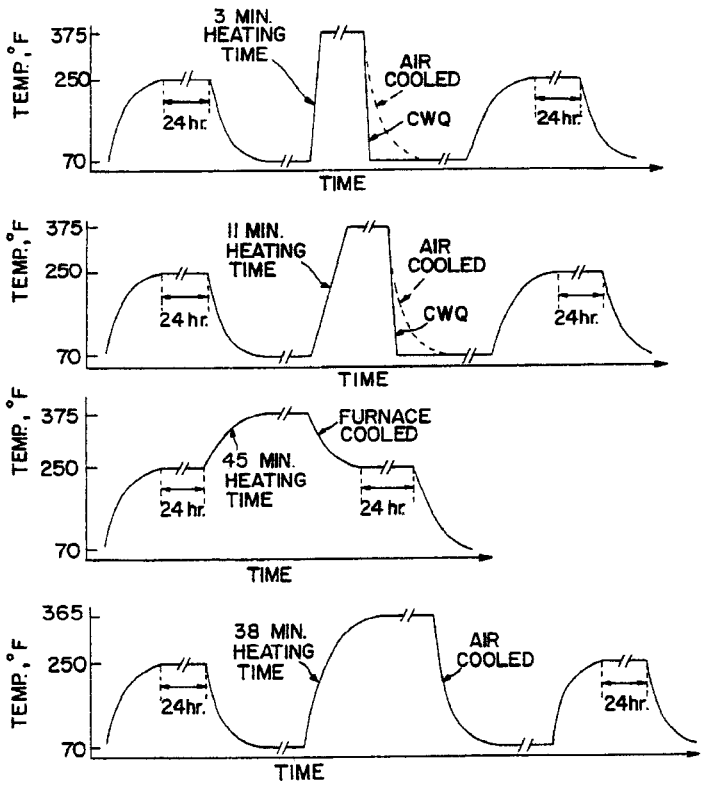

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–12 and 34 are cancelled.

Claims 13, 21–25, 27, 28 and 35–44 are determined to be patentable as amended.

Claims 14–20, 26, 29–33 and 45–54, dependent on an amended claim, are determined to be patentable.

New claims 55–65 are added and determined to be patentable.

13. An aging process for solution-heat-treated, precipitation hardening [7×××-type] aluminum alloy *consisting essentially of about 4 to 12% Zn, about 1.9 to 2.7% Mg, about 1.9 to 2.6% Cu, about 0.08 to 0.25% Zr, balance substantially aluminum and incidental elements and impuritites*, comprising (1) aging the alloy at one or more temperatures substantially above room temperature but below about 325° F. to substantially below peak yield strength, (2) [subsequently] aging the alloy at one or more temperatures of about [330° F. for] *350° F. or* higher, *for at least 15 minutes up to about 3 hours cumulative time at temperatures of about 350° F. or higher,* for increasing resistance of the alloy to corrosion, and thereafter (3) aging the alloy at one or more temperatures substantially above room temperature but below about 325° F. for increasing yield strength.

21. An aging process for an aluminum alloy [containing] *consisting essentially of* about 5.7 to 6.9% Zn, about 1.9 to 2.7% Mg, about 1.9 to 2.6% Cu, and about 0.08 to 0.18% Zr, *the balance substantially aluminum and incidental elements and impurities,* said process comprising:

(1) aging the alloy at one or more temperatures within about 175° F. to 325° F. to a yield strength below peak yield strengh by 4 ksi or more;

(2) aging the alloy at one or more temperatures above about [330° F.] *350° F. for at least about 15 minutes up to about 3 hours cumulative time at temperatures above about 350° F.* to increase the alloy's resistance to corrosion; and (3) aging the alloy at one or more temperatures within about 175° to 325° F. to increase the alloy's strength.

22. An aging process as claimed in claim 21 wherein said recitation (2) aging is *for about 15 minutes to 3 hours* within about 360° to 400° F. [for about 5 minutes to three hours].

23. An aging process for solution-heat-treated, precipitation hardening [7×××-type] aluminum alloy *consisting essentially of about 4 to 12% Zn, about 1.9 to 2.7% Mg, about 1.9 to 2.6% Cu, about 0.08 to 0.25% Zr, balance substantially aluminum and incidental elements and impurities*, comprising (1) aging the alloy at one or more temperatures substantially above room temperature but below about 325° F. to a yield strength below peak yield strength by about 3 ksi or more, (2) aging the alloy at one or more temperatures of about [330° F.] *350° F.* or higher for at least [3] *15* minutes but not more than 3 hours cumulative time at temperatures of [330° F.] *about 350° F.* or higher, and (3) aging the alloy at one or more temperatures above room temperature but below 325° F. for about 2 hours or more.

24. An aging process for solution-heat-treated, precipitation hardening [7×××-type] aluminum alloy *consisting essentially of about 4 to 8% Zn, about 1.9 to 2.7% Mg, about 1.9 to 2.6% Cu, about 0.08 to 0.25% Zr, balance substantially aluminum and incidental elements and impurities*, comprising (1) aging the alloy at one or more temperatures within about 175° F. to about 325° F. to a strength substantially below peak yield strength, (2) aging the alloy at one or more temperatures of at least about [330° F.] *350° F.* but less than 500° F. for about [4] *15* minutes to about 3 hours cumulative time at temperatures of [330° F.] *about 350° F.* or higher, and (3) aging the alloy at one or more temperatures within about 175° F. to about 325° F. for about 2 hours or more.

25. An aging process as claimed in claim 24, the aluminum alloy consisting essentially of about 5.7 to 6.9% Zn, about 1.9 to 2.7% Mg, about 1.9 to 2.6% Cu, about 0.08 to [0.18%] *0.25%* Zr, balance substantially aluminum and incidental elements and impurities.

27. A process for aging an aluminum alloy consisting essentially of about 5.7 to 6.9% Zn, about 1.9 to 2.7% Mg, about 1.9 to 2.6% Cu, about 0.08 to 0.18% Zr, balance substantially aluminum and incidental elements and impurities, comprising (1) aging the alloy at one or more temperatures within about 175° F. to about 325° F. for about 2 hours or more to a strength at least 3 ksi below peak yield strength, (2) aging the alloy at one or more [temperatuares] *temperatures* of at least about 330° F. but less than 500° F. for about [4] *15* minutes to about 3 hours cumulative time at temperatures of 330° F. or higher, and (3) aging the alloy at one or more temperatures within about 175° F. to about 325° F. for about 2 hours or more.

28. A product produced by the process of claim [1] *66*.

35. A product produced by the process of claim [3] *56*.

36. A product produced by the process of claim [4] *57*.

37. A product produced by the process of claim [5] *58*.

38. A product produced by the process of claim [6] *59*.

39. A product produced by the process of claim [7] *60*.

40. A product produced by the process of claim [8] *61*.

41. A product produced by the process of claim [9] *62*.

42. A product produced by the process of claim [10] *63*.

43. A product produced by the process of claim [11] *64*.

44. A product produced by the process of claim [12] *65*.

*55. An aging process as claimed in claim 23, wherein, in said recitation (1), said aging is to 4 ksi or more below peak yield strength.*

*56. An aging process as claimed in claim 24, wherein, in said recitation (1), said aging is to 4 ksi or more below peak yield strength.*

*57. An aging process as claimed in claim 27, wherein, in said recitation (1), said aging is to 4 ksi or more below peak yield strength.*

*58. An aging process as claimed in claim 21, wherein, in said recitation (1), said aging is to 5 ksi or more below peak yield strength.*

*59. An aging process as claimed in claim 23, wherein, in said recitation (1), said aging is to 5 ksi or more below peak yield strength.*

*60. An aging process as claimed in claim 24, wherein, in said recitation (1), said aging is to 5 ksi or more below peak yield strength.*

*61. An aging process as claimed in claim 27, wherein, in said recitation (1), said aging is to 5 ksi or more below peak yield strength.*

*62. An aging process as claimed in claim 21, wherein, in said recitation (1), said aging is to 6 ksi or more below peak yield strength.*

*63. An aging process as claimed in claim 23, wherein, in said recitation (1), said aging is to 6 ksi or more below peak yield strength.*

*64. An aging process as claimed in claim 24, wherein, in said recitation (1), said aging is to 6 ksi or more below peak yield strength.*

*65. An aging process as claimed in claim 27, wherein, in said recitation (1), said aging is to 6 ksi or more below peak yield strength.*

* * * * *